US009825398B1

(12) United States Patent
Uchida et al.

(10) Patent No.: US 9,825,398 B1
(45) Date of Patent: Nov. 21, 2017

(54) WATERPROOF CONNECTOR

(71) Applicant: J.S.T. Mfg. Co., Ltd., Osaka-shi (JP)

(72) Inventors: Shinji Uchida, Yokohama (JP); Kunitoshi Kanazawa, Yokohama (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 15/593,848

(22) Filed: May 12, 2017

(30) Foreign Application Priority Data

May 17, 2016 (JP) ..... 2016-098810

(51) Int. Cl.

| | |
|---|---|
| ***H01R 13/52*** | (2006.01) |
| ***H01R 24/28*** | (2011.01) |
| *H01R 107/00* | (2006.01) |
| *G04B 37/08* | (2006.01) |

(52) U.S. Cl.
CPC ..... *H01R 13/5219* (2013.01); *H01R 24/28* (2013.01); *G04B 37/08* (2013.01); *H01R 2107/00* (2013.01)

(58) Field of Classification Search
CPC ..... H01R 13/5219
See application file for complete search history.

(56) References Cited

U.S. PATENT DOCUMENTS 6,475,008 B1 * 11/2002 Marolda ..... H01R 13/523 439/271
7,811,116 B2 * 10/2010 Sakakura ..... H01R 4/302 439/364
8,257,107 B2 * 9/2012 Tsuruta ..... H01R 13/621 439/362
8,348,689 B2 * 1/2013 Shibata ..... H01R 13/5202 174/153 G
8,425,256 B2 * 4/2013 Aoki ..... H01R 13/688 439/620.26
8,491,323 B2 * 7/2013 Ishibashi ..... H01R 13/5221 439/205
8,562,377 B2 * 10/2013 Kawamura ..... H01R 9/032 439/607.44
8,622,674 B2 * 1/2014 Shibata ..... H01R 13/5202 411/105

(Continued)

FOREIGN PATENT DOCUMENTS

JP 2010-003442 A1 1/2010

*Primary Examiner* — Ross Gushi
(74) *Attorney, Agent, or Firm* — Kratz, Quintos & Hanson, LLP

(57) ABSTRACT

In the waterproof connector, a receptacle is provided with a first housing and first contacts, and a plug is provided with a second housing and second contacts. The first housing has a header at one end portion side and a quadrangular shaped waterproof ring mounted to allow close contact with an outer perimeter of the header. The second housing has in its interior a second contact housing chamber into which the header can be introduced, and has a shell which surrounds a periphery of the plurality of second contacts. The waterproof ring has a first pucker, formed with an undulating shape at an outer perimeter of the front portion, and which can closely contact at an inner wall of the shell, and a second pucker, formed with an undulating shape at an outer perimeter of the rear portion, and which can closely contact at an inner wall of a first frame.

6 Claims, 8 Drawing Sheets

(56) References Cited

U.S. PATENT DOCUMENTS 8,738,097 B2 * 5/2014 Hong ..... H01R 13/5202 455/575.1
8,790,135 B2 * 7/2014 Maegawa ..... H01R 13/521 439/246
8,808,012 B2 * 8/2014 Omae ..... H01R 4/646 439/98
8,808,026 B2 * 8/2014 Yamaguchi ..... H01R 13/5202 439/559
9,106,000 B2 * 8/2015 Mizutani ..... H01R 13/4365
9,112,296 B2 * 8/2015 Zhang ..... H01R 13/516
9,225,103 B2 * 12/2015 Okamoto ..... H01R 13/5202
9,281,609 B2 * 3/2016 Suzuki ..... H01R 13/5202
9,312,626 B2 * 4/2016 Itsuki ..... H01R 13/5208
9,331,421 B2 * 5/2016 Lai ..... H01R 13/5202
9,337,568 B2 * 5/2016 Endo ..... H01R 13/4365
9,343,941 B2 * 5/2016 Okamoto ..... H01R 13/5202
9,429,360 B2 * 8/2016 Hsiao ..... F26B 3/28
9,478,897 B2 * 10/2016 Kashiwada ..... H01R 13/5219
9,570,831 B2 * 2/2017 Nakai ..... H01R 13/4226
9,570,839 B2 * 2/2017 Hashimoto ..... H01R 13/5202
9,685,731 B2 * 6/2017 Chonan ..... H01R 13/5221
9,711,910 B2 * 7/2017 Zhao ..... H01R 13/5202
9,728,890 B2 * 8/2017 Nakai ..... H01R 13/5816
9,728,910 B2 * 8/2017 Lee ..... H01R 24/38
9,742,098 B2 * 8/2017 Zhao ..... H01R 13/5202
9,755,384 B2 * 9/2017 Bury ..... H01R 25/006
2002/0155756 A1 * 10/2002 Yoshioka ..... H01R 4/023 439/582
2009/0318004 A1 * 12/2009 Cours ..... H01R 13/5219 439/304
2010/0015826 A1 * 1/2010 Daily ..... H01R 13/504 439/147
2010/0112841 A1 * 5/2010 Yong ..... H01R 13/74 439/271
2012/0003856 A1 * 1/2012 Yamaguchi ..... H01R 13/5202 439/271
2012/0312346 A1 * 12/2012 Roman, Jr. ..... H01R 13/5808 136/244
2013/0023973 A1 * 1/2013 Richard ..... A61N 1/375 607/116
2013/0171854 A1 * 7/2013 Homme ..... H01R 13/5202 439/272
2013/0203277 A1 * 8/2013 Gaubert ..... H01R 13/6277 439/271
2016/0043500 A1 * 2/2016 Mori ..... H01R 13/504 439/271
2016/0056590 A1 * 2/2016 Sugiyama ..... H01R 13/405 439/277
2016/0226347 A1 * 8/2016 Okamoto ..... H01R 13/5202
2017/0005432 A1 * 1/2017 Bernhart ..... H01R 13/533
2017/0012382 A1 * 1/2017 Coenegracht ..... H01R 13/508
2017/0145272 A1 * 5/2017 Ooki ..... C09K 3/1018
2017/0149166 A1 * 5/2017 Mann ..... H01R 13/5202
2017/0162975 A1 * 6/2017 Tsai ..... H01R 13/5202
2017/0250495 A1 * 8/2017 Yudate ..... H01R 13/5202

* cited by examiner

WATERPROOF CONNECTOR

This application is based on and claims the benefit of priority from Japanese Patent Application No. 2016-098810, filed on 17 May 2016, the content of which is incorporated herein by reference.

BACKGROUND OF THE INVENTION

Field of the Invention

The present invention relates to a waterproof connector. In particular, the present invention relates to the structure of a waterproof connector which prevents the entry of water into the interior of an electric connector, which is an electric connector suitable for electrically connecting wristwatch type wearable devices and peripheral devices provided in wristbands.

Related Art

In recent years, transportable terminals which can be worn on a portion of the body such as the arm or head, namely, wearable devices, have been developed to be practicable. For example, an electric connector is used in order to electrically connect a wristwatch type wearable device to a peripheral device provided in a wrist band. Further, wristwatch type wearable devices and the like are assumed to be used outdoors, and therefore, this electric connector is required to have a waterproof property.

For example, Japanese Unexamined Patent Application, First Publication No. 2010-3442 (below referred to as Patent Document 1) discloses a waterproof connector (below referred to as a "jack"). The jack of Patent Document 1 is provided with a rectangular solid shaped cover housing and a rectangular solid shaped jack housing. Further, the jack is provided with a cylindrically shaped central terminal and a ground terminal consisting of leaf spring member.

Patent Document 1 discloses a waterproof connector which prevents short circuiting of the central terminal and the ground terminal even if water enters the interior of the jack. Therefore, in the jack, for example, a quadrangular frame shaped first seal member, a disk shaped second seal member, and a ring shaped third seal member and the like are arranged at suitable locations.

However, considering that the jack (waterproof connector) disclosed in Patent Document 1 utilizes multiple types of seal members, as well as the assembly workload (assembly time) thereof, this becomes a primary factor in increasing the manufacturing costs of the waterproof connector. There is demand for a waterproof connector with a simple constitution which is capable of contributing to a reduction of the manufacturing costs, and which is suitable for connections of wearable devices and the like. This can be said to be the problem to be solved by the present invention.

The present invention is one which was made in consideration of problems such as those described above, and has the objective of providing a waterproof connector with a simple constitution which is capable of contributing to a reduction in manufacturing costs, and which is suitable for connections of wearable devices and the like.

SUMMARY OF THE INVENTION

The present inventors, in order to satisfy the above described objective, discovered that the above described problem can be solved by a waterproof connector wherein a first connector and a second connector are mutually detachable, and wherein a first housing has a header and a quadrangular frame shaped waterproof ring mounted to allow close contact with an outer perimeter of the header, a second housing has a quadrangular tube shaped shell into which the header can be introduced, and constituting the waterproof ring of a first pucker which allows close contact with an inner wall of the shell, and a second pucker which allows close contact with an inner wall of a first frame, and based on this, arrived at the invention of a novel waterproof connector as described below.

The first aspect of the present invention is a waterproof connector wherein a first connector fixed to an end portion of a first frame and a second connector fixed to an end portion of a second frame are mutually detachable, wherein the first connector is provided with a rectangular solid shaped first housing with an interrupted opening disposed at one face and has in its interior a first contact housing chamber, and a plurality of first contacts arranged inside the first contact housing chamber; the second connector is provided with a strip shaped second housing, and a plurality of second contacts which are respectively connectable with the plurality of first contacts, with a base end portion fixed to the second housing, and with a tip portion side protruding from one face of the second housing; the first housing has a header which protrudes at one end portion side, and a quadrangular frame shaped waterproof ring mounted to allow close contact with an outer perimeter of the header; the second housing has in its interior a second contact housing chamber into which the header can be introduced, as well as a quadrangular tube shaped shell which surrounds a periphery of the plurality of second contacts; and the waterproof ring has one or more first puckers formed with an undulating shape at an outer perimeter of a front portion and which can closely contact at an inner wall of the shell, and one or more second puckers formed with an undulating shape at an outer perimeter of a rear portion and which can closely contact at an inner wall of the first frame.

The second aspect of the present invention is a waterproof connector according to the first aspect, wherein the waterproof ring has a step which can accommodate a squeeze of the first pucker, between the first pucker and the second pucker.

The third aspect of the present invention is a waterproof connector according to claim 1, wherein the first contact has at a tip portion side thereof a bifurcated pair of branched arms, and the second contact consists of a blade shaped blade contact which can enter between the pair of branched arms.

The fourth aspect of the present invention is a waterproof connector according to any one of the first to third aspects, wherein the first frame comprises a lug formed at an end portion of a case which holds a wearable device, and the second frame is comprised at an end portion of a wristband rotatably connected to the lug.

BRIEF DESCRIPTION OF THE DRAWINGS

FIG. 1A shows a state wherein the first connector and the second connector are disposed facing each other, and FIG. 1B shows a state wherein the first connector and the second connector are fit together.

FIG. 2A shows a state wherein the first connector and the second connector are disposed facing each other, and FIG. 2B shows a state wherein the first connector and the second connector are fit together.

FIG. 5A is a front view of the first connector, FIG. 5B is a plan view of the first connector, FIG. 5C is a right side view of the first connector, FIG. 5D is a bottom view of the first connector, and FIG. 5E is a rear view of the first connector.

FIG. 6A is a front view of the second connector, FIG. 6B is a plan view of the second connector, FIG. 6C is a right side view of the second connector, FIG. 6D is a bottom view of the second connector, and FIG. 6E is a rear view of the second connector.

DETAILED DESCRIPTION OF THE INVENTION

Below, forms for practicing the present invention are explained with reference to the drawings.

[Constitution of the Waterproof Connector]

First, the constitution of the waterproof connector according to one embodiment of the present invention is explained.

Figure 1A:
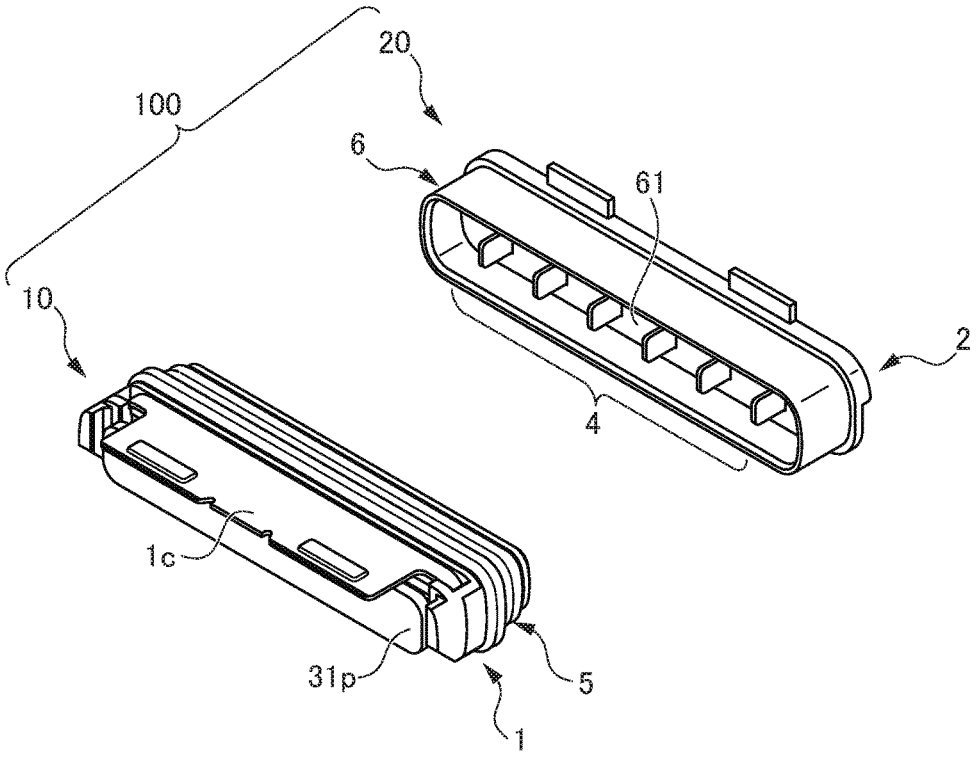
FIG. 1A and FIG. 1B are drawings showing the constitution of the waterproof connector according to one embodiment of the present invention.
Figure 1B:
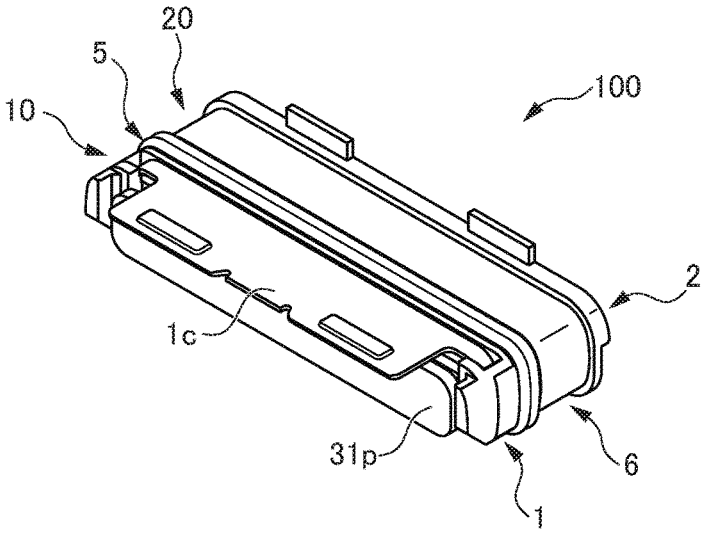

FIG. 1A and FIG. 1B are drawings showing the constitution of the waterproof connector according to one embodiment of the present invention, and FIG. 1A shows a state wherein the first connector and the second connector are disposed facing each other, and FIG. 1B shows a state wherein the first connector and the second connector are fit together.

Figure 2A:
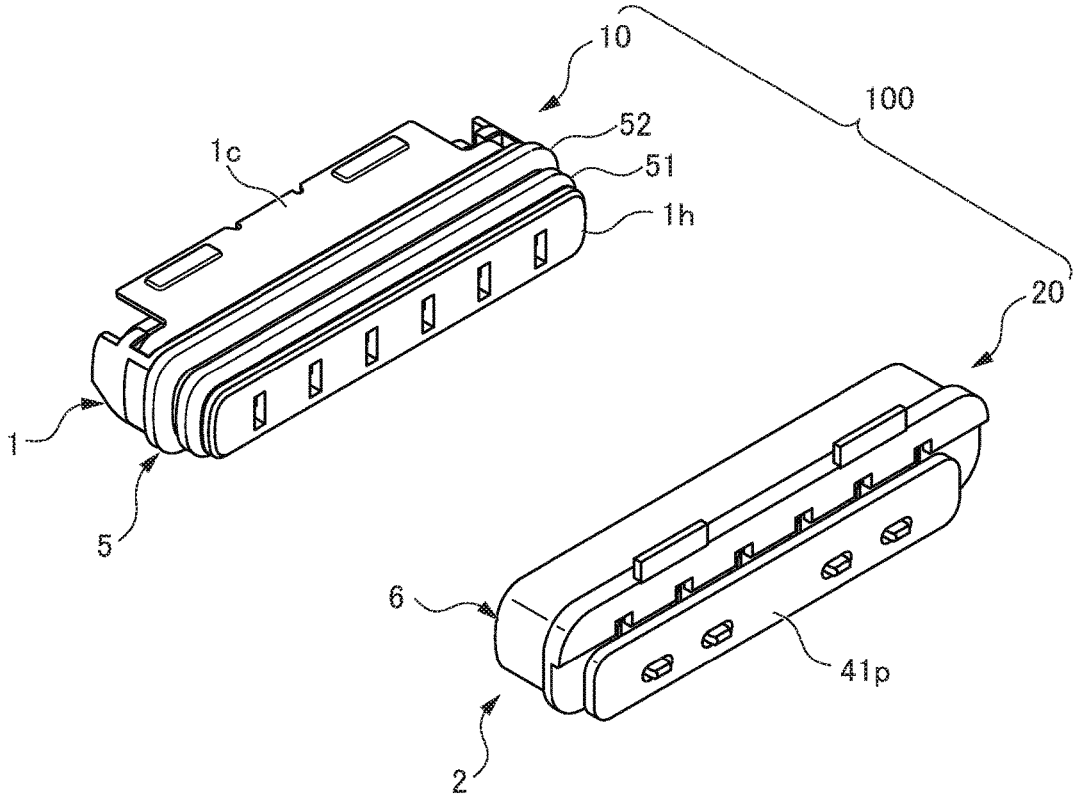
FIG. 2A and FIG. 2B are drawings showing the constitution of the waterproof connector according to the above mentioned embodiment.
Figure 2B:
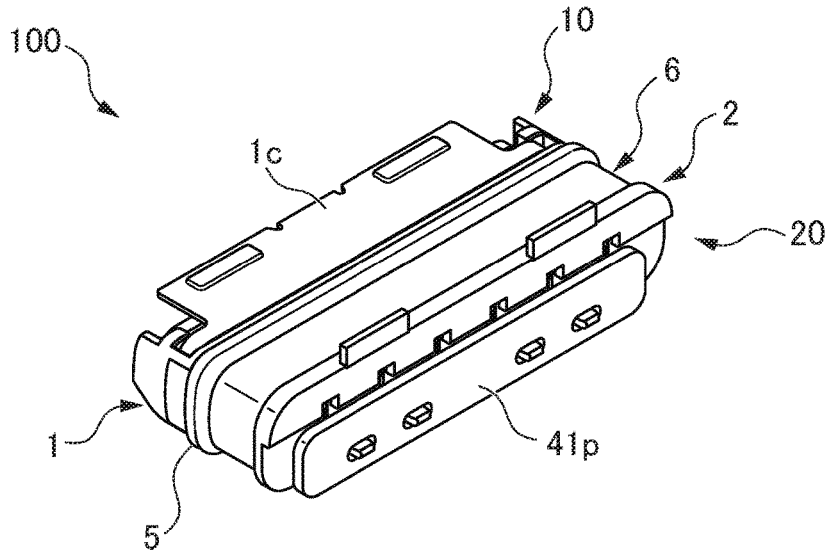

FIG. 2A and FIG. 2B are drawings showing the constitution of the waterproof connector according to the above mentioned embodiment, and FIG. 2A shows a state wherein the first connector and the second connector are disposed facing each other, and FIG. 2B shows a state wherein the first connector and the second connector are fit together.

Figure 3:
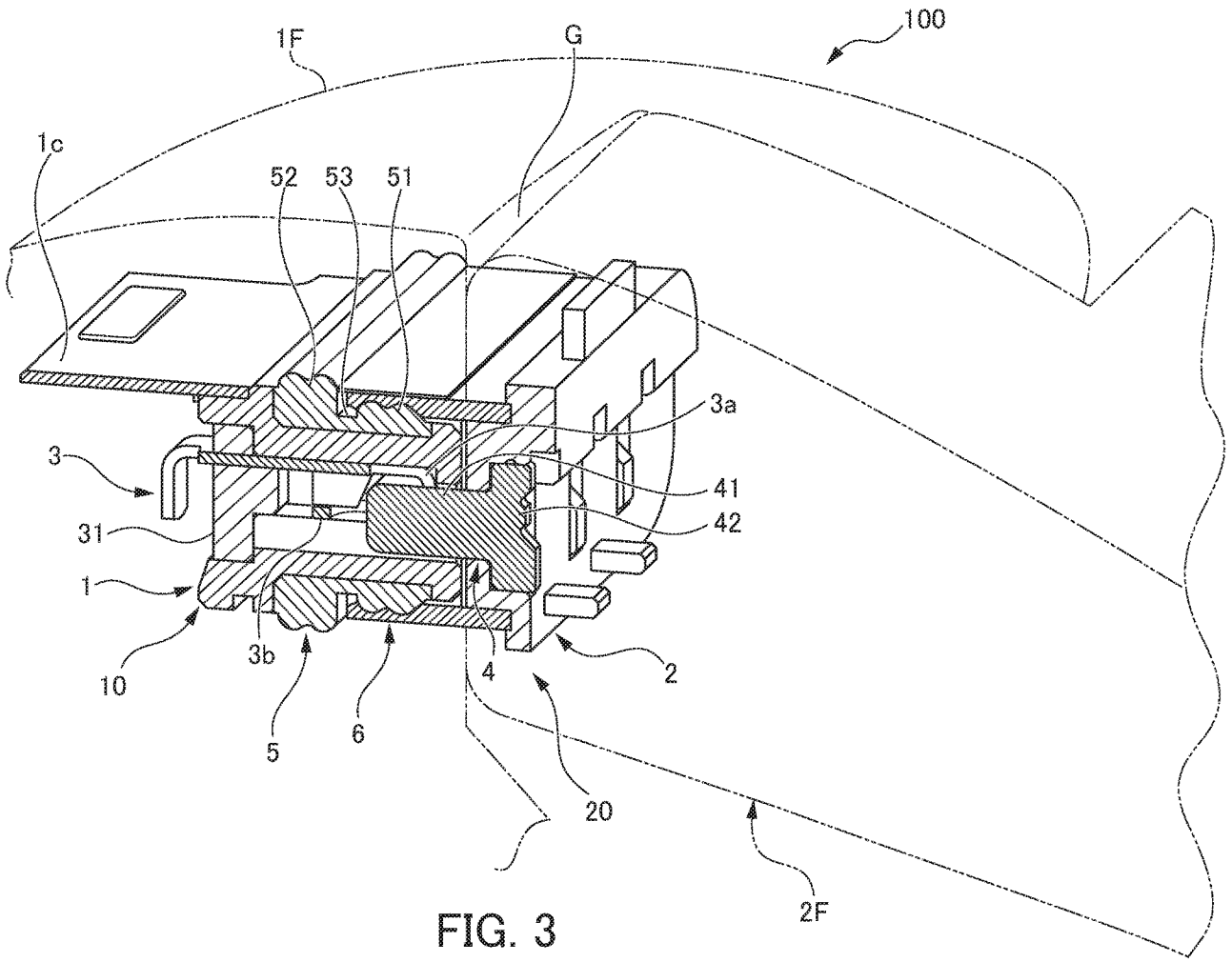
FIG. 3 is an oblique cross sectional drawing showing the constitution of the waterproof connector according to the above mentioned embodiment, and shows a state wherein the first connector and the second connector are fit together.

FIG. 3 is an oblique cross sectional drawing showing the constitution of the waterproof connector according to the above mentioned embodiment, and shows a state wherein the first connector and the second connector are fit together.

Figure 4:
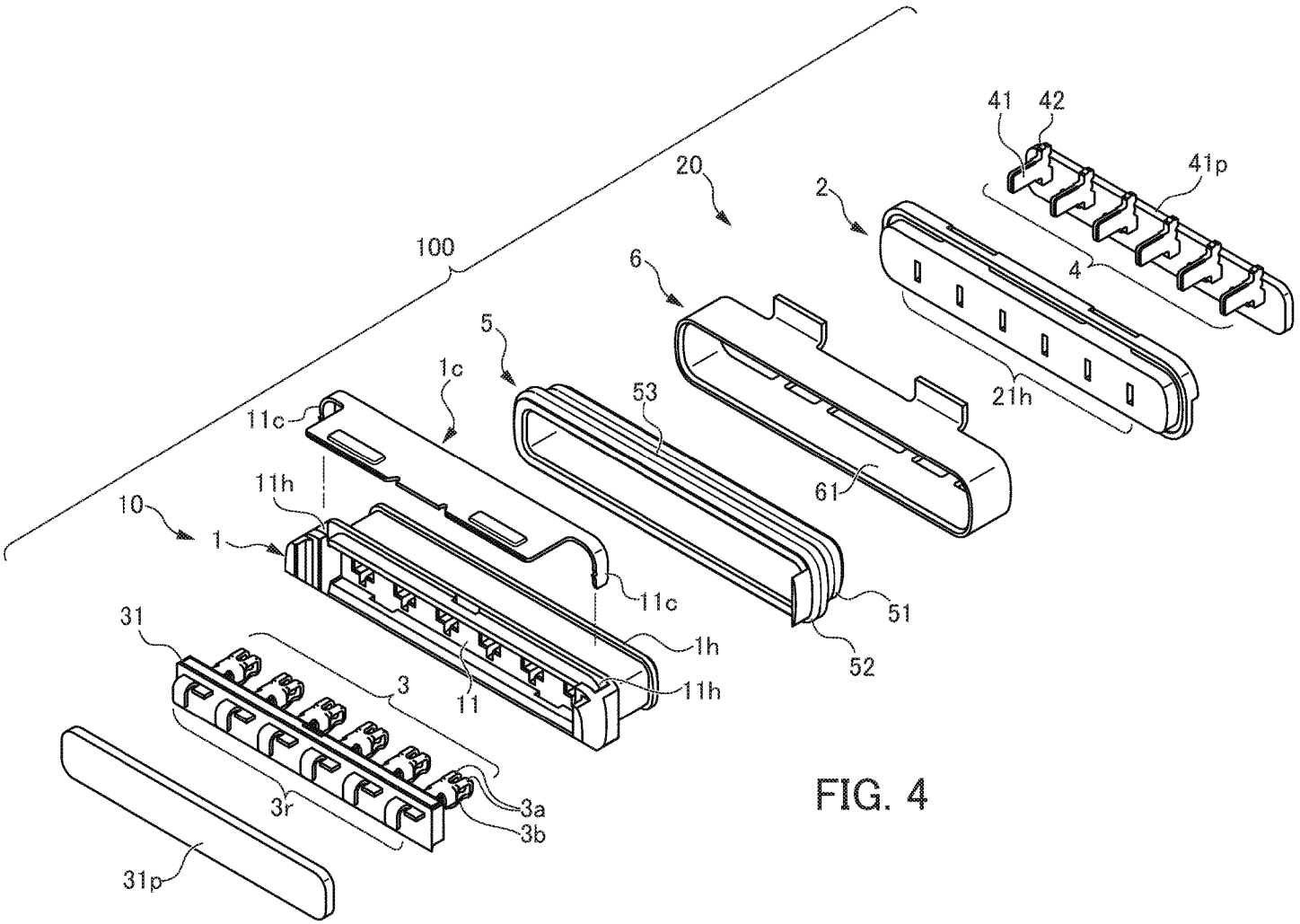
FIG. 4 is an oblique exploded drawing showing the constitution of the waterproof connector according to the above mentioned embodiment.

FIG. 4 is an oblique exploded drawing showing the constitution of the waterproof connector according to the above mentioned embodiment.

Figure 5B:
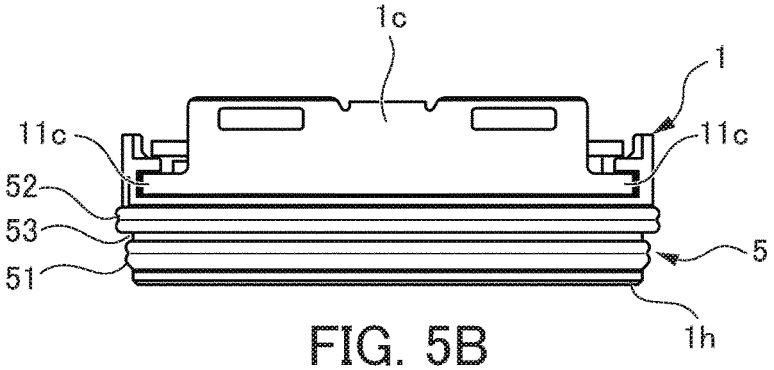
FIG. 5A, FIG. 5B, FIG. 5C, FIG. 5D and FIG. 5E are drawings showing the constitution of the first connector according to the above mentioned embodiment.
Figure 5A:
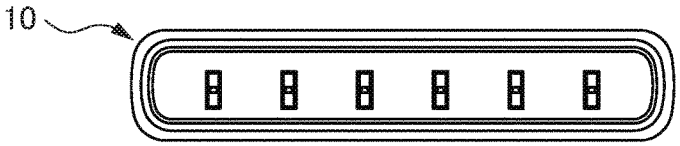
Figure 5C:
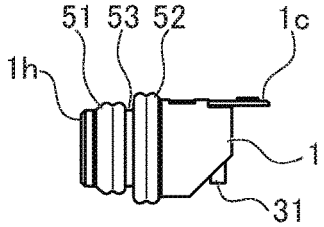
Figure 5D:
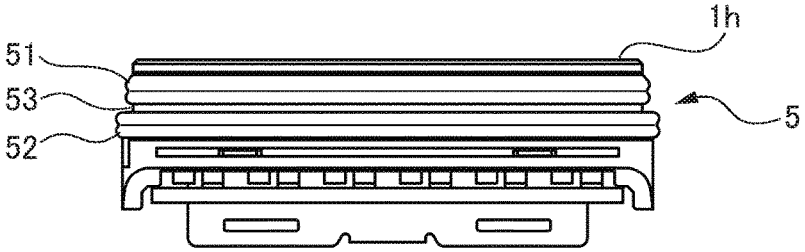
Figure 5E:
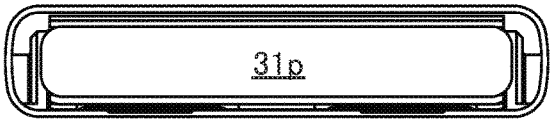

FIG. 5A, FIG. 5B, FIG. 5C, FIG. 5D and FIG. 5E are drawings showing the constitution of the first connector according to the above mentioned embodiment, and FIG. 5A is a front view of the first connector, FIG. 5B is a plan view of the first connector, FIG. 5C is a right side view of the first connector, FIG. 5D is a bottom view of the first connector, and FIG. 5E is a rear view of the first connector.

Figure 6B:
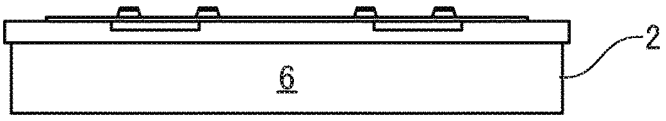
FIG. 6A, FIG. 6B, FIG. 6C, FIG. 6D and FIG. 6E are drawings showing the constitution of the second connector according to the above mentioned embodiment.
Figure 6A:
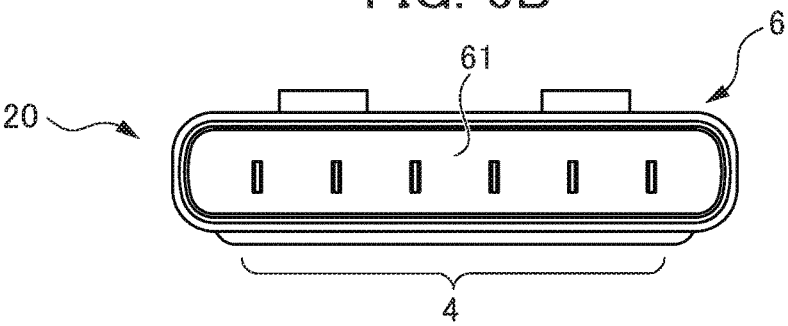
Figure 6C:
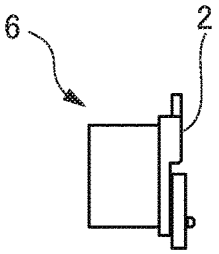
Figure 6D:
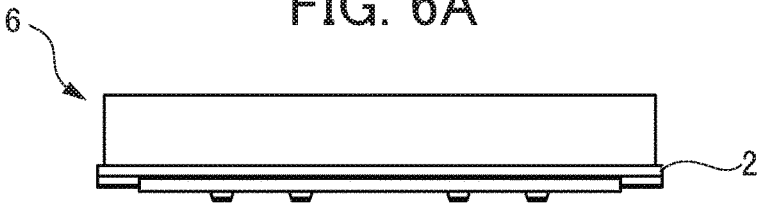
Figure 6E:
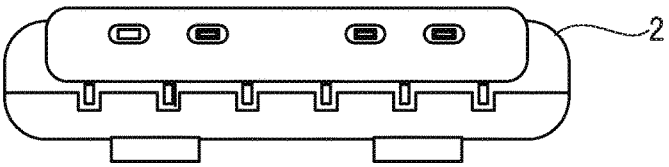

FIG. 6A, FIG. 6B, FIG. 6C, FIG. 6D and FIG. 6E are drawings showing the constitution of the second connector according to the above mentioned embodiment, and FIG. 6A is a front view of the second connector, FIG. 6B is a plan view of the second connector, FIG. 6C is a right side view of the second connector, FIG. 6D is a bottom view of the second connector, and FIG. 6E is a rear view of the second connector.

Figure 7B:
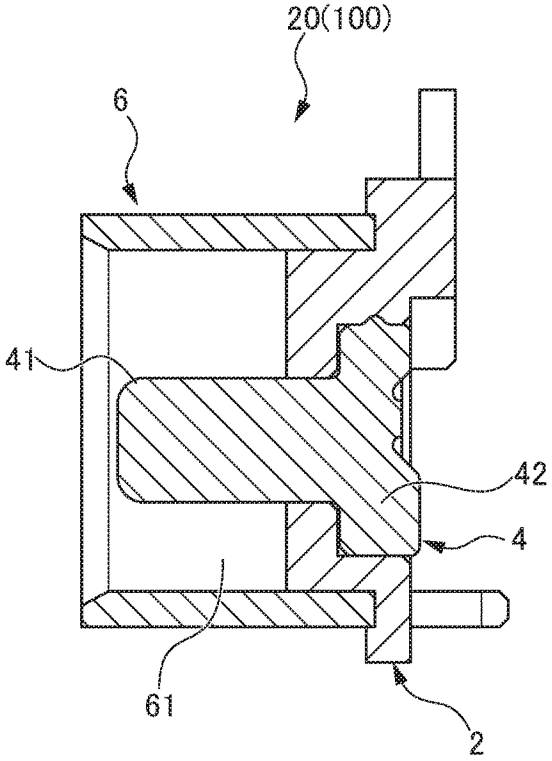
FIG. 7A and FIG. 7B are longitudinal sectional views showing the constitution of the waterproof connector according to the above mentioned embodiment, and shows a state wherein the first connector and the second connector are disposed facing each other.
Figure 7A:
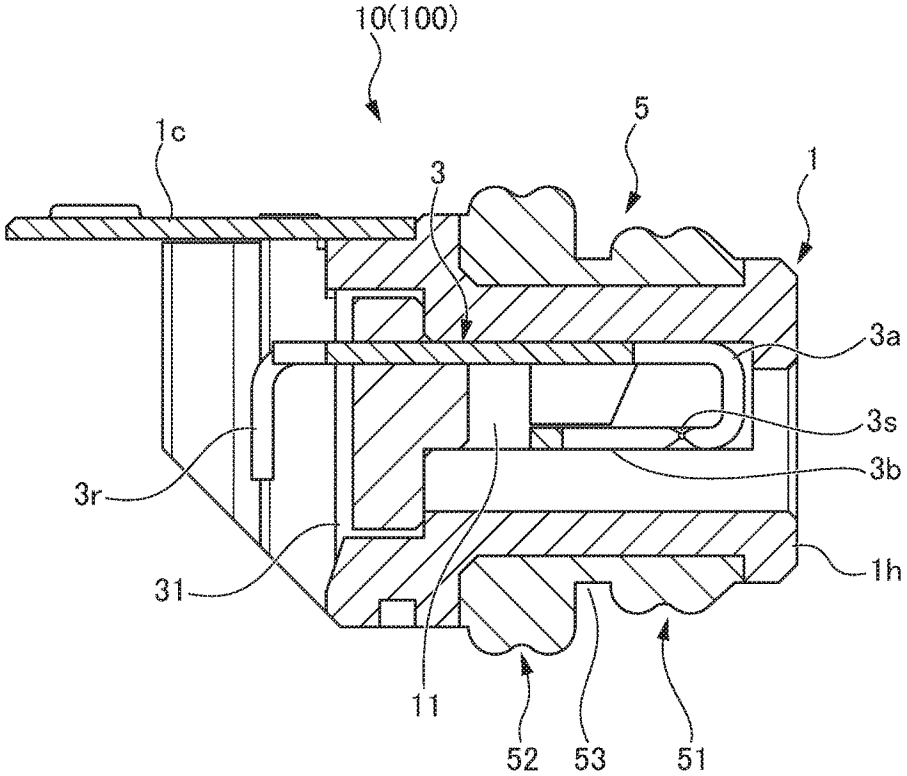

FIG. 7A and FIG. 7B are longitudinal sectional views showing the constitution of the waterproof connector according to the above mentioned embodiment, and shows a state wherein the first connector and the second connector are disposed facing each other.

Figure 8:
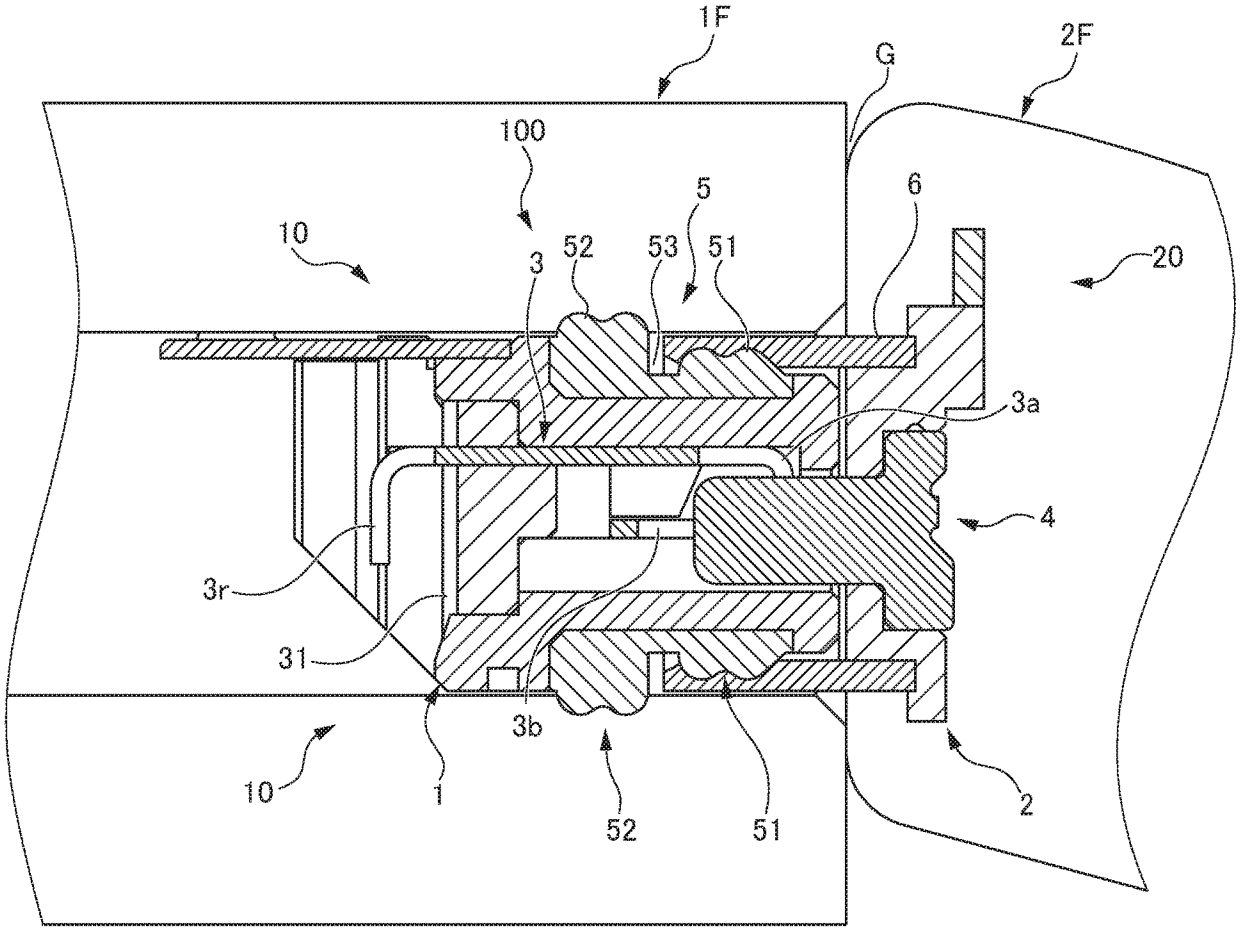
FIG. 8 is a longitudinal sectional view showing the constitution of the waterproof connector according to the above mentioned embodiment, and shows a state wherein the first connector and the second connector are fit together.

FIG. 8 is a longitudinal sectional view showing the constitution of the waterproof connector according to the above mentioned embodiment, and shows a state wherein the first connector and the second connector are fit together.

(Overall Constitution)

With reference to FIG. 1A, FIG. 1B, FIG. 2A, FIG. 2B, FIG. 3, FIG. 4, FIG. 5A, FIG. 5B, FIG. 5C, FIG. 5D, FIG. 5E, FIG. 6A, FIG. 6B, FIG. 6C, FIG. 6D, FIG. 6E, FIG. 7A, FIG. 7B and FIG. 8, in the waterproof connector 100 according to one embodiment of the present invention a first connector (below referred to as the receptacle) 10 and a second connector (below referred to as the plug) 20 can be mutually detached.

With reference to FIG. 3 or FIG. 8, the receptacle 10 is fixed to an end portion of a first frame 1F. The first frame 1F holds, for example, a wristwatch type wearable device (not shown in the drawings). The first frame 1F may comprise a lug formed at an end portion of the case holding the wearable device, not shown in the drawings. Further, the receptacle 10 is electrically connected to the wearable device (not shown in the drawings).

On the other hand, with reference to FIG. 3 or FIG. 8, the plug 20 is fixed to the end portion of the second frame 2F. The second frame 2F holds a peripheral device of the wearable device which is not shown in the drawings. The second frame 2F can be constituted, for example, of a wristband which is rotatably connected the first frame 1F. The second frame 2F may comprise an end portion of the wrist band rotatably connected to the lug.

With reference to FIG. 1A, FIG. 1B, FIG. 2A, FIG. 2B, FIG. 3, FIG. 4, FIG. 5A, FIG. 5B, FIG. 5C, FIG. 5D and FIG. 5E, the receptacle 10 is provided with a rectangular solid shaped first housing 1, and a plurality of first contacts 3. The first housing 1 is provided with an interrupted opening at one face. Further, the first housing 1 has in its interior a first contact housing chamber 11 (refer to FIG. 3 or FIG. 7A). The first contact 3 is disposed inside the first contact housing chamber 11 (refer to FIG. 3 or FIG. 7A).

With reference to FIG. 1A, FIG. 1B, FIG. 2A, FIG. 2B, FIG. 3 and FIG. 4, and FIG. 6A, FIG. 6B, FIG. 6C, FIG. 6D and FIG. 6E or FIG. 7B, the plug 20 is provided with a strip shaped second housing 2, and a plurality of second contacts 4. The second contacts 4 are fixed at their base end portions to the second housing 2. Further, the tip portion sides of the second contacts 4 protrude from one face of the housing 2, and the second contacts 4 can connect with the first contacts 3.

With reference to FIG. 2A or FIG. 4 and FIG. 5A, FIG. 5B, FIG. 5C, FIG. 5D and FIG. 5E or FIG. 7A, the first housing 1 has a header 1*h* and a quadrangular frame shaped waterproof ring 5. The header 1*h* protrudes at one end portion side of the first housing 1. The waterproof ring 5 is mounted to allow close contact with an outer perimeter of the header 1*h*.

With reference to FIG. 1A, FIG. 1B, FIG. 2A, FIG. 2B, FIG. 3 and FIG. 4 or FIG. 6A, FIG. 6B, FIG. 6C, FIG. 6D and FIG. 6E and FIG. 7B, the second housing 2 has a quadrangular tube shaped shell 6. The shell 6 has in its interior a second contact housing chamber 61 into which the header 1*h* can be introduced. Further, the shell 6 surrounds the periphery of the plurality of second contacts 4.

With reference to FIG. 3 or FIG. 7A and FIG. 8, the waterproof ring 5 has two first puckers 51 and two second puckers 52. The first pucker 51 is formed with an undulating shape at an outer perimeter of the front portion the waterproof ring 5 and can closely contact at the inner wall of the shell 6. The second pucker 52 is formed with an undulating shape at an outer perimeter of the rear portion of the waterproof ring 5 and can closely contact at the inner wall of the first frame 1F. Further, FIG. 3 or FIG. 8 show a state before the first pucker 51 and the second pucker 52 are compressed.

With reference to FIG. 3 or FIG. 8, in the waterproof connector 100 according to the embodiment, the first pucker 51 of the waterproof ring 5 which has closely contacted the outer perimeter of the receptacle 10 is closely contacting the inner wall of the shell 6, and therefore, water which has penetrated from the gap G between the first frame 1F and the second frame 2F can be prevented from penetrating into the interior of the shell 6.

Further, with reference to FIG. 3 or FIG. 8, in the waterproof connector 100 according to the embodiment, the second pucker 52 of the waterproof ring 5 is closely contacting the inner wall of the first frame 1F, and therefore, it is possible to prevent water which has penetrated from the gap G between the first frame 1F and the second frame 2F from penetrating into the interior of the first frame 1F.

(Constitution of the First Housing)

Next, the constitution of the first housing 1 according to the embodiment will be explained. With reference to FIG. 1A, FIG. 1B, FIG. 2A, FIG. 2B, FIG. 3, FIG. 4, FIG. 5A, FIG. 5B, FIG. 5C, FIG. 5D, FIG. 5E, FIG. 6A, FIG. 6B, FIG. 6C, FIG. 6D, FIG. 6E, FIG. 7A and FIG. 7B, the first housing 1 has insulating properties, and can be obtained in the desired shape by forming a synthetic resin consisting of a nonconductive material.

With reference to FIG. 1A, FIG. 1B, FIG. 2A, FIG. 2B, FIG. 3, FIG. 4, FIG. 5A, FIG. 5B, FIG. 5C, FIG. 5D and FIG. 5E, the first housing 1 is provided with a strip shaped fitting 1*c*. The fitting 1*c* has a pair of press fitting pieces 11*c*, 11*c* which are bent at approximately right angles, at both ends (refer to FIG. 4). On the other hand, the upper wall of the first housing 1 is provided with a pair of press fitting holes 11*h*, 11*h* (refer to FIG. 4).

With reference to FIG. 4, by press fitting the press fitting pieces 11*c* into the press fitting holes 11*h*, the fitting 1*c* can be fixed to the first housing 1. Thus, using the fitting 1*c*, the receptacle 10 can be integrated with an end portion of the first frame 1F (refer to FIG. 3 or FIG. 8).

(Constitution of the First Contact)

Next, the constitution of the first contact 3 according to the embodiment will be explained. With reference to FIG. 3 or FIG. 4 and FIGS. 7A and 7B, the first contact 3 has conductivity, and the desired shape can be obtained by stamping from a conductive metal plate. For the first contact 3, in consideration of ease of production, spring characteristics, conductivity and the like, for example, a copper alloy may be preferably used, without being limited to copper alloys.

With reference to FIG. 3 or FIG. 4 and FIGS. 7A and 7B, the first contact 3 at its base end portion has a lead terminal 3*r*. Further, the first contact 3 has at its tip portion side a bifurcated pair of branched arms 3*a*, 3*a*. At the lead terminal 3*r* it is possible to connect a flexible printed substrate (below referred to as FPC) 31*p*. The FPC 31*p* is electrically connected to a wearable device, not shown in the drawings. Further, in FIG. 3 or FIG. 7A and FIG. 7B and FIG. 8, an illustration of the FPC 31*p* is omitted.

With reference to FIG. 3 or FIG. 4 and FIGS. 7A and 7B, the pair of branched arms 3*a*, 3*a* has a pair of inverted arms 3*b*, 3*b* inverted towards the lead terminal 3*r*. The tip portions of the pair of inverted arms 3*b*, 3*b* are joined to each other. Further, at the inner wall of the inverted arm 3*b* a hemispherical contact 3*s* protrudes (refer to FIG. 7A and FIG. 7B).

From the state shown in FIGS. 7A and 7B, when a contact piece 41 of the second contact 4 enters between the pair of branched arms 3*a*, 3*a* (refer to FIG. 3 or FIG. 8), a pair of contacts 3*s*, 3*s* can sandwich the contact piece 41. Thus, the first contact 3 and the second contact 4 can be electrically connected.

With reference to FIG. 4, the receptacle 10 is further provided with a strip shaped insulation piece 31. The insulation piece 31 is integrally formed with the base end portion side of the first contact 3. The plurality of first contacts 3 are fixed to the insulation piece 31 in an aligned state. In the receptacle 10, by integrating the insulating piece 31 from the back face side of the first housing 1, plurality of first contacts 3 can be disposed in an aligned state.

(Constitution of the Waterproof Ring)

Next, the constitution of the waterproof ring 5 according to the embodiment will be explained. With reference to FIG. 3 or FIG. 4 and FIGS. 7A and 7B, the waterproof ring 5 preferably consists of natural rubber or synthetic rubber, and has elasticity. It is possible to obtain a waterproof ring 5 with the desired shape by forming natural rubber or synthetic rubber.

With reference to FIG. 3 or FIG. 5A, FIG. 5B, FIG. 5C, FIG. 5D and FIG. 5E and FIGS. 7A and 7B, the waterproof ring 5 has a step 53 between the first pucker 51 and the second pucker 52. With reference to FIG. 3 or FIG. 8, in a state wherein the first pucker 51 is closely contacting an inner wall of the shell 6, the step 53 can accommodate the squeeze of the first pucker 51.

(Constitution of the Second Housing)

Next, the constitution of the second housing 2 according to the embodiment will be explained. With reference to FIG. 1A, FIG. 1B, FIG. 2A, FIG. 2B, FIG. 3 and FIG. 4, and FIG. 6A, FIG. 6B, FIG. 6C, FIG. 6D and FIG. 6E, the second housing 2 has insulating properties, and can be obtained in the desired shape by forming a synthetic resin consisting of a nonconductive material.

With reference to FIG. 3 or FIGS. 7A and 7B, the second housing 2 is mold formed so as to block the other opening of the shell 6 at the base end portion side of the shell 6. Further, a plurality of press fitting holes 21*h* are opened in the second housing 2 (refer to FIG. 4). The second contacts 4 can be press fit into the press fitting holes 21*h*.

(Constitution of the Second Contact)

Next, the constitution of the second contact 4 according to the embodiment will be explained. With reference to FIG. 3 or FIGS. 6A to 6E and FIGS. 7A and 7B, the second contact 4 has conductivity, and can be obtained in the desired shape by stamping from a conductive metal plate. For the second contact 4, in consideration of ease of production, spring characteristics, conductivity and the like, for example, a copper alloy may be preferably used, without being limited to copper alloys.

With reference to FIG. 3 or FIG. 4 and FIGS. 7A and 7B, constituting one end portion side thereof, the second contact 4 has a contact piece 41 and a press fitting piece 42. The contact piece 41 preferably consists of a blade shaped blade contact which can enter between the pair of branched arms 3*a*, 3*a*. The press fitting piece 42 can be fixed to the second housing 2 by press fitting into the press fitting hole 21*h* opened in the second housing 2.

With reference to FIG. 4, the bottom face of the press fitting piece 42 is soldered to the FPC 41*p*. The FPC 41*p* can be electrically connected to a peripheral device provided at a wrist band, not shown in the drawings. Further, in FIG. 3 or FIGS. 7A, 7B and FIG. 8, the FPC 41*p* is omitted from the drawings.

[Operation of the Waterproof Connector]

Next, while explaining the action of the waterproof connector 100 according to the embodiment, the operation and effects of the waterproof connector 100 will be explained.

From the state shown in FIGS. 7A and 7B, by inserting the header 1*h* of the first housing 1 into the second contact housing chamber 61 of the plug 20, the first contact 3 and the second contact 4 can be electrically connected (refer to FIG. 8). In the state shown in FIG. 8, it is possible to electrically connect a wearable device (not shown in the drawings) provided at the first frame 1F and a peripheral device, not shown in the drawings, provided at the second frame 2F.

With reference to FIG. 3 or FIG. 8, in the waterproof connector 100 according to the embodiment, the first pucker 51 of the waterproof ring 5 which is in close contact with the outer perimeter of the receptacle 10 closely contacts the inner wall of the shell 6, and therefore, water which has penetrated from the gap G between the first frame 1F and the second frame 2F can be prevented from penetrating into the interior of the shell 6.

Further, with reference to FIG. 3 or FIG. 8, in the waterproof connector 100 according to the embodiment, the second pucker 52 of the waterproof ring 5 closely contacts the inner wall of the first frame 1F, and therefore, water which has penetrated from the gap G between the first frame 1F and the second frame 2F can be prevented from penetrating into the interior of the first frame 1F.

With reference to FIG. 1A, FIG. 1B, FIG. 2A, FIG. 2B, FIG. 3, FIG. 4, FIG. 5A, FIG. 5B, FIG. 5C, FIG. 5D, FIG. 5E, FIG. 6A, FIG. 6B, FIG. 6C, FIG. 6D, FIG. 6E, FIG. 7A, FIG. 7B and FIG. 8, the waterproof connector according to the embodiment uses only one waterproof ring 5 and has a simple constitution compared to the waterproof connectors of the prior art. In this way, the waterproof connector 100 according to the embodiment can contribute to reducing manufacturing costs.

Further, with reference to FIG. 1A, FIG. 1B, FIG. 2A, FIG. 2B, FIG. 3, FIG. 4, FIG. 5A, FIG. 5B, FIG. 5C, FIG. 5D, FIG. 5E, FIG. 6A, FIG. 6B, FIG. 6C, FIG. 6D, FIG. 6E, FIG. 7A, FIG. 7B and FIG. 8, the waterproof connector 100 according to the embodiment has a bifurcated pair of branched arms 3*a*, 3*a* at a tip portion side of the first contact 3, and is provided with a blade shaped blade contact which can enter between the pair of branched arms 3*a*, 3*a* at the tip portion side of the second contact 4, and therefore, even if the second frame 2F rotates with respect to the first frame 1F, the state of contact between the first contact 3 and the second contact 4 can be securely maintained.

The waterproof connector according to the present invention discloses an electric connector suitable for a wristwatch type wearable device, but the waterproof connector according to the present invention is also expected to be applied to AR glasses for implementing augmented reality (AR) experiences by being fit on the head as eyeglasses.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. A waterproof connector wherein a first connector fixed to an end portion of a first frame and a second connector fixed to an end portion of a second frame are mutually detachable, wherein the first connector is provided with a rectangular solid shaped first housing with an interrupted opening disposed at one face and having in its interior a first contact housing chamber, and a plurality of first contacts arranged inside the first contact housing chamber, the second contact is provided with a strip shaped second housing, and a plurality of second contacts which are respectively connectable with the plurality of first contacts, with a base end portion fixed to the second housing, and with a tip portion side protruding from one face of the second housing, and wherein the first housing has a header which protrudes at one end portion side, and a quadrangular frame shaped waterproof ring mounted to allow close contact with an outer perimeter of the header, the second housing has in its interior a second contact housing chamber into which the header can be introduced, as well as a quadrangular tube shaped shell which surrounds a periphery of the plurality of second contacts, and the waterproof ring has one or more first puckers formed with an undulating shape at an outer perimeter of a front portion and which can closely contact at an inner wall of the shell, and one or more second puckers formed with an undulating shape at an outer perimeter of a rear portion and which can closely contact at an inner wall of the first frame.

2. A waterproof connector according to claim 1, wherein the first contact has at a tip portion side thereof a bifurcated pair of branched arms, and the second contact consists of a blade shaped blade contact which can enter between the pair of branched arms.

3. A waterproof connector according to claim 1, wherein the first frame comprises a lug formed at an end portion of a case which holds a wearable device, and the second frame comprises an end portion of a wristband rotatably connected to the lug.

4. A waterproof connector according to claim 1, wherein the waterproof ring has a step which can accommodate a squeeze of the first pucker, between the first pucker and the second pucker.

5. A waterproof connector according to claim 4, wherein the first contact has at a tip portion side thereof a bifurcated pair of branched arms, and the second contact consists of a blade shaped blade contact which can enter between the pair of branched arms.

6. A waterproof connector according to claim 5, wherein the first frame comprises a lug formed at an end portion of a case which holds a wearable device, and the second frame comprises an end portion of a wristband rotatably connected to the lug.

* * * * *